US006315597B1

(12) United States Patent
Coyne et al.

(10) Patent No.: US 6,315,597 B1
(45) Date of Patent: Nov. 13, 2001

(54) POWER CONNECTOR FOR RELEASABLE ENGAGED RETENTION OF A WIRE

(75) Inventors: James Christopher Coyne, New Providence; James T. LaGrotta, Boonton; Richard Thomas LaGrotta, Livingston, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/464,144

(22) Filed: Dec. 16, 1999

(51) Int. Cl.[7] ..... H01R 11/20

(52) U.S. Cl. ..... 439/436; 439/29; 439/441; 439/816

(58) Field of Search ..... 439/23, 25, 29, 439/436, 66, 816, 817, 823, 441, 438

(56) References Cited

U.S. PATENT DOCUMENTS 3,255,428 * 6/1966 Robbins ..... 439/441
5,746,606 5/1998 Sobhani ..... 439/21

* cited by examiner

*Primary Examiner*—Paula Bradley
*Assistant Examiner*—Truc Nguyen
(74) *Attorney, Agent, or Firm*—Cohen, Pontani, Lieberman & Pavane

(57) ABSTRACT

A power connector for receipt and releasable engagement with a wire to effect a transmitting power electrical connection to the wire. The power connector includes a connector housing having a wire insertion side with an opening for receiving the wire. A spring contact is disposed within the housing and includes an attachment end for attaching the spring contact to the connector housing and a contact end for contact with the wire. The spring contact includes a substantially C-shaped segment extending between the attachment end and contact end. The C-shaped segment is dimensioned to be maintained under compression and so that the spring contact applies a contact force against an inserted wire at the contact end with a force sufficient for supporting the conducting of electricity between the wire and contact end. The C-shaped segment is further oriented so that when a lateral force is imparted to the C-shaped segment from the wire-insertion side of the housing, the contact force applied against the wire is reduced to thereby reduce the force required to disengage and remove the wire from the connector housing.

10 Claims, 2 Drawing Sheets

POWER CONNECTOR FOR RELEASABLE ENGAGED RETENTION OF A WIRE

BACKGROUND OF THE INVENTION

1. Field of the Invention

The present invention relates to power connectors and, in particular, to a power connector that provides high contact force to a wire but requires low insertion and removal forces.

2. Description of the Related Art

Prior art power connectors such as the screw-type connector block and spring-loaded connectors require special tools to torque the adjustment screw so that proper contact force is applied to the power-transmitting wire connected thereto. Incorrect torque values often result in a high resistance connection between the wire and the spring contact, which could lead to fire or equipment failures. Furthermore, prior art power connectors require very high insertion and removal forces to assure a high normal contact force, thereby rendering the connectors difficult to use.

Accordingly, there is a need for a spring type power connector that requires low insertion and removal forces relative to the normal contact force and which accommodates a range of wire gages.

SUMMARY OF THE INVENTION

An object of the present invention is to provide a low-cost, easy-to-use power connector.

According to one aspect of the invention, the inventive power connector includes a spring contact configured such that its contact end lifts off when a user-applied force is directed laterally against the spring contact.

According to another aspect of the invention, the spring contact is formed of a strip material having a thickness optimized with respect to stresses arising from the intended uses.

In one embodiment, the power connector includes a connector housing having a wire insertion side defining an opening for receiving a wire to be connected to the power connector. Also included is a spring contact having an attachment end for attaching the spring contact to the connector housing and a contact end for contacting the wire. The spring contact has a substantially C-shaped segment extending longitudinally from the attachment end and toward the contact end. The substantially C-shaped segment is dimensioned such that the spring contact applies a contact force against the wire through the contact end sufficient for conducting electricity between the wire and the contact end. The segment is furthermore oriented so that when a lateral force is imparted to the spring contact from the wire-insertion side of the housing, the contact force applied against the wire is lessened to thereby reduce the force required to remove the wire from the connector housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
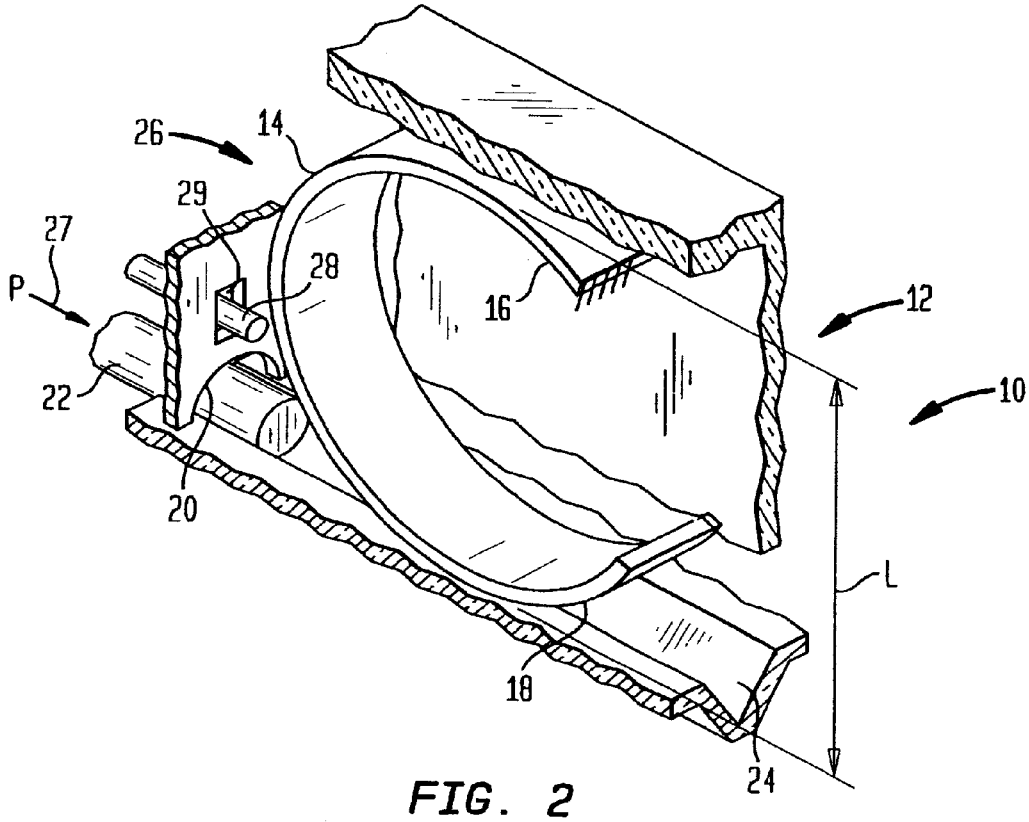
FIG. 1 is a sectional view of a substantially C-shaped spring contact of a power connector in accordance with one embodiment of the invention.

With specific reference now to the drawings, FIG. 1 illustrates one embodiment of a power connector 10 constructed in accordance with the present invention. The power connector 10 includes a housing 12, at least one spring contact 14 having a segment such, for example, as a substantially C-shaped having a height L, an attachment end 16 for fixedly attaching the spring contact to the housing 12, and a contact end 18 for engagement with a wire inserted or insertable in the housing 12. The housing 12 may be formed of a dielectric material suitable for the intended use environments. Preferably, the housing 12 includes a wire insertion side with an opening 20 for receiving such a wire 22 therethrough and a groove 24 (e.g. a V-shaped groove) defined in a bottom wall of the housing 12 and configured to guide the wire 22 into engagement with the contact end 18 of the spring contact. The substantially C-shaped spring contact 14 is oriented so that the "convex" or outwardly facing side 26 of the C-shaped segment faces the wire-insertion side of the power connector housing 12.

Preferably, the spring contact 14 has a stiffness (i.e. a spring constant) such that the contact end 18 applies an appropriate normal force against the longitudinal surface of an inserted wire 22, even though wire 22 may be selected from a predetermined range of gage sizes (e.g., 14 AWG to 10 AWG). The spring contact 14 may for example be formed of beryllium copper.

In use, a wire is inserted through the wire insertion side opening 20 and pushed along the groove 24 into engagement with the contact end 18 so that the wire is pressed between the end 18 and groove 24. Removal of the wire 22 from power connector 10 is accomplished through the application of a laterally directed force P (or a force having a lateral component), as indicated by the arrow 27, imparted to the outwardly facing side 26 of C-shaped spring 14, preferably adjacent, or proximate the contact end 18 of the spring. As depicted in FIG. 1, the force P may be applied through a user-manipulable protruding member 28. The protruding member 28 is oriented to impart the requisite force/deflection to the outwardly facing surface of the C-shaped spring 14 so as to cause the contact end 18 of the C-shaped spring 14 to lift upwardly from the bottom wall of housing 12, thereby reducing the force required to remove wire 22 from connector 10. The protruding member 28 may for example comprise a portion of a lever-actuated mechanism (not shown) that is formed as an integral part of the power connector assembly. Alternatively, the protruding member may comprise a spring-mounted lever attached to the connector housing 12 such that upon depression by a user, the protruding member 28 imparts the requisite deflection to C-shaped spring 14, and upon release the protruding member 28 returns to its rest position. In another embodiment, the protruding member 28 may comprise a portion of a removable tool (e.g., the tip of a screwdriver) inserted through opening 29 of the wire-inserting side of connector housing 12.

Figure 2:
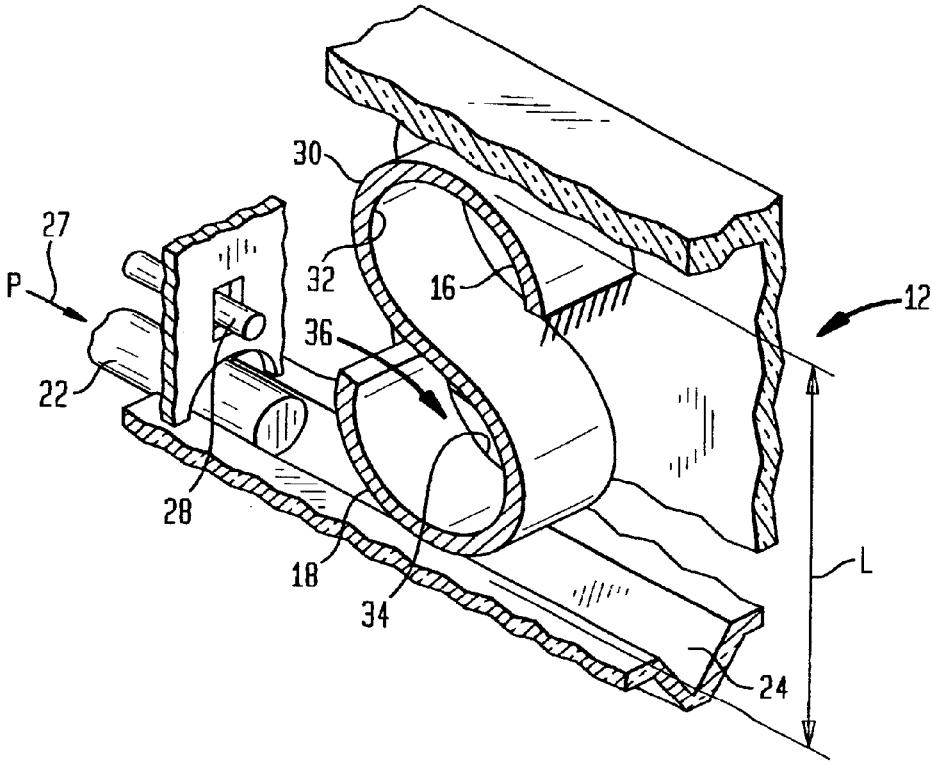
FIG. 2 is a sectional view of a substantially S-shaped spring contact of a power connector in accordance with another embodiment of the invention.

FIG. 2 depicts another embodiment of the inventive power connector 10 in which the spring contact 30 is substantially S-shaped (i.e., having oppositely facing upper and lower arcuate segments 32, 34). As with the C-shaped spring 14, this S-shaped spring 30 having a height L has an attachment end 16 for attaching the spring to the connector housing 12 and a contact end 18 for engaging the wire 22. The S-shaped spring 30 is oriented so that the upper arcuate segment 32 carrying the attachment end 16 is oriented in substantially the same direction as the C-shaped segment 14 of FIG. 1. In other words, the "concave" side 36 of the lower arcuate segment 34 of the spring is oriented toward the wire-insertion side of connector housing 12. A lateral force P imparted to the contact end 18 of the spring causes the contact end 18 to decrease the normal contact force applied against an inserted wire 22.

In a particularly preferred embodiment, the spring contact 14, 30 is fabricated from a strip of conductive material having a Young's Modulus E, and a rectangular cross section of width w and thickness t. The connector housing 12 has a V-shaped groove 24 dimensioned to guide, for example, 14 AWG to 10 AWG wire such that a minimum required contact force $F_{Y,MIN}$ can be applied by the spring against the smallest diameter wire of the range. The contact force applied by the spring 14, 30 on a larger wire will, of course, be greater than that applied against the smallest diameter wire and, given this variation in wire sizes, the spring will operatively undergo a range of deflections $\Delta U_Y$ in the vertical direction (i.e. the direction normal to the bottom wall of housing 12).

Figure 3A:
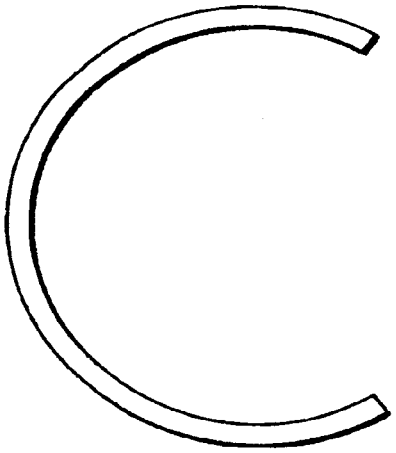
FIG. 3A depicts a semicircular C-shaped spring.
Figure 3B:
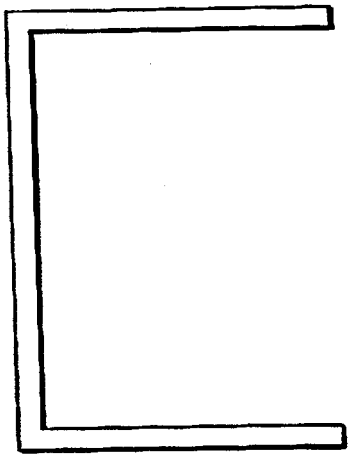
FIG. 3B depicts a rectangular C-shaped spring.
Figure 3C:
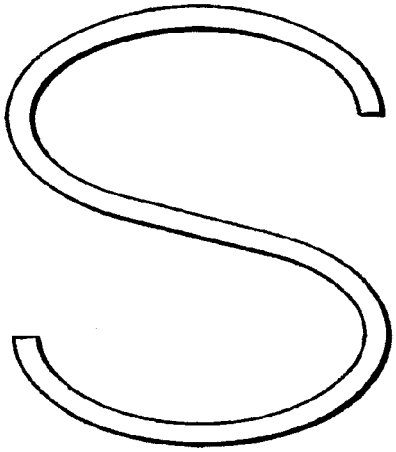
FIG. 3C depicts a sinusoidal S-shaped spring.
Figure 3D:
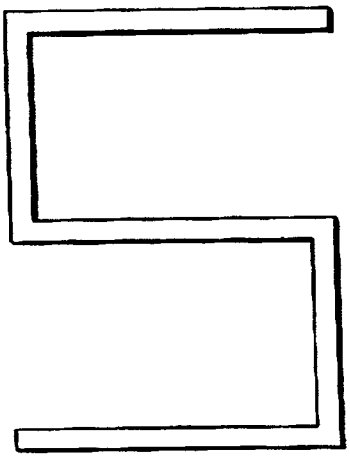
FIG. 3D depicts a rectangular S-shaped spring.

It has been discovered that when the attachment end 16 of the spring contact is fixed to the power connector housing 12, akin to the manner in which a "cantilever beam" is attached to a support surface, an optimum thickness $t_{OPT}$ for the spring may be computed which minimizes the spring's bending stress. Thus, a spring of height L and width w, with a minimum contact force $F_{y,min}$, a range of deflections $\Delta Uy$, and a Young's Modulus E will have the least bending stress when the spring's thickness is computed as follows:

$$t_{OPT} = 2L\left(\frac{3\Psi F_{y,\min}}{wE\Delta U_y}\right)^{\frac{1}{3}}$$

where $\Psi$ is a function of the shape of the spring expressed in terms of the friction coefficient $\mu$. $\Psi$ has been derived for the following shapes:

| Spring Shape | $\Psi$ |
|---|---|
| Semicircular "C" shape (see FIG. 3A) | $2\mu + \pi/2$ |
| Rectangular "C" shape (see FIG. 3B) | $3\mu + 2.667$ |
| Sinusoidal-wave-like "S" shape (see FIG. 3C) | $\mu/2 + \pi/8$ |
| Square-wave-like rectangular "S" shape (see FIG. 3D) | $(3/4)\mu + 2/3$ |

Therefore, an optimized spring, having the least stress and therefore the longest fatigue life can be fabricated using the above formula.

While there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A power connector for releasable engaged retention of a wire, comprising:

a connector housing having a wire insertion side defining an opening for receiving a wire therethrough for releasable retention by the power connector;

a spring contact disposed m said housing and having an attachment end for attaching the spring contact to said connector housing and a contact end for releasable, electrical connection-effecting contact with the wire, said spring contact having a substantially C-shaped segment extending between the attachment end and the contact end, said substantially C-shaped segment being dimensioned so that said spring contact is normally maintained within the housing in a compressed state and so as to apply, when the wire is inserted through the opening and received in said housing for engagement with the contact end, a wire-retaining contact force against the wire at the contact end and sufficient for conducting electricity between the wire and the contact end, and said C-shaped segment being oriented so that when a lateral force is applied to the spring contact from the wire-insertion side of the housing, the wire-retaining contact force applied against the wire at the contact end is reduced to thereby facilitate disengagement of the wire from the contact end and removal of the wire from within the connector housing, wherein said spring contact is dimensioned to accommodate a predetermined range of wire gauge sizes and a spring contact thickness $t_{OPT}$ that is calculated as follows in order to minimize the spring contact's bending stress and to maximize the spring contact's fatigue life:

$$t_{OPT} = 2L\left(\frac{3\psi F_{y,\min}}{wE\Delta U_y}\right)^{\frac{1}{3}}$$

where w is the substantially rectangular cross-section width of the strip, L is the height of the strip, E is the Young's Modulus of the spring contact material, $F_{y,min}$ is a minimum desired contact force of the contact end on the wire, $\Delta U_Y$ is a range of spring defections to accommodate the predetermined range of wire gauge sizes, and $\psi$ is a function of the shape of the spring contact expressed in terms of the friction coefficient $\mu$.

2. The power connector of claim 1, wherein said substantially C-shaped segment has a convex side and said segment is oriented so that said convex side is disposed in confronting opposition to the wire-insertion side of said housing.

3. The power connector of claim 1, wherein said substantially C-shaped segment is configured to have a rectangular C-shaped with substantially sharp bends, and wherein $\psi=3\mu+2.667$.

4. The power connector of claim 1, wherein said substantially C-shaped segment comprises a semi-circular arcuate segment, and wherein $\psi=2\mu+\pi/2$.

5. The power of claim 1, wherein said C-shaped segment comprises a first C-shaped segment and said spring contact further comprises a second substantially C-shaped segment connected to said first segment and oriented in an opposite direction from siad first C-shaped so that said spring contact is substantially S-shaped.

6. The power connector of claim 5, wherein said substantially S-shaped spring contact has a sinusoidal-wave-like shape, and wherein $\psi=\mu/2+\pi/8$.

7. The power connector of claim 6, wherein said substantially S-shaped spring contact has a square-wave-like shape, and wherein $\psi=(3/4)\mu+2/3$.

8. The power connector of claim 1, wherein said connector housing includes a groove for slidably guiding the wire into the housing for engagement with the contact end of said spring contact.

9. The power connector of claim 8, wherein said groove has a V-shaped configuration.

10. The power connector of claim 1, wherein said spring contact is formed of beryllium-copper.

* * * * *